United States Patent [19]

Landolt

[11] 4,176,506

[45] Dec. 4, 1979

[54] VACUUM PACKING MACHINE WITH TILTABLE ROLLER STACKING PLATE

[75] Inventor: Bruno Landolt, Herisau, Switzerland

[73] Assignee: Inauen Maschinen AG, Herisau, Switzerland

[21] Appl. No.: 916,660

[22] Filed: Jun. 19, 1978

[51] Int. Cl.[2] ..... B65B 31/02

[52] U.S. Cl. ..... 53/86; 53/512

[58] Field of Search ..... 53/79, 86, 89, 94, 95, 53/512

[56] References Cited

U.S. PATENT DOCUMENTS 3,508,373 4/1970 Robinson ..... 53/86 X

FOREIGN PATENT DOCUMENTS 1597655 6/1970 France ..... 53/512

*Primary Examiner*—Travis S. McGehee

*Attorney, Agent, or Firm*—Sughrue, Rothwell, Mion, Zinn and Macpeak

[57] ABSTRACT

A roller surfaced stacking plate 4 is slidably hinged at one end to a framework 5 in the vacuum chamber 2 of a packing machine. The framework may be vertically raised and lowered by a pneumatic cylinder 8 and a linkage 12, 14, 19, and is horizontally displaced during such movement by reason of its pivotal connection to a counterpoise bar 22. A tilt lever 26 is pivotally connected between the framework and plate, and one end thereof bears against a bolt pin 29 extending into the vacuum chamber. With such an arrangement the plate 4 and framework 5 lie in a horizontal plane when they are retracted within the chamber 2, and the plate 4 is tilted out over the edge 31 of the machine to slidably discharge the vacuum packed products when the framework is raised. The depth of retraction within the chamber is adjustable to accommodate bagged products of various thicknesses.

5 Claims, 3 Drawing Figures

VACUUM PACKING MACHINE WITH TILTABLE ROLLER STACKING PLATE

BACKGROUND OF THE INVENTION

This invention is concerened with a vacuum packing machine.

In conventional machines of this type, the bagged material to be packed is manually placed in the vacuum chamber by an operator and the cover is closed. In order to accommodate the different heights of the material to be packed, one or more filler plates are usually placed on the bottom of the chamber. After evacuation, the packed material must be manually removed from the chamber again and delivered for further handling. This method of operation is not efficient, and such conventional packing machines are not suitable for installation in a high speed packing production line.

SUMMARY OF THE INVENTION

It is therefore an object of the invention to eliminate the above disadvantages by providing a vacuum packing machine with a stacking plate that can be lowered into the vacuum chamber to an adjustable depth. The stacking plate has a roller surface and is installed on a horizontal framework that can move up and down, with the plate being inclined relative to the framework and extending over one edge of the housing in its extreme upper position, and lying in the plane of the framework in its adjustable, extreme lower position.

DETAILED DESCRIPTION OF THE PREFERRED EMBODIMENT

Figure 1:
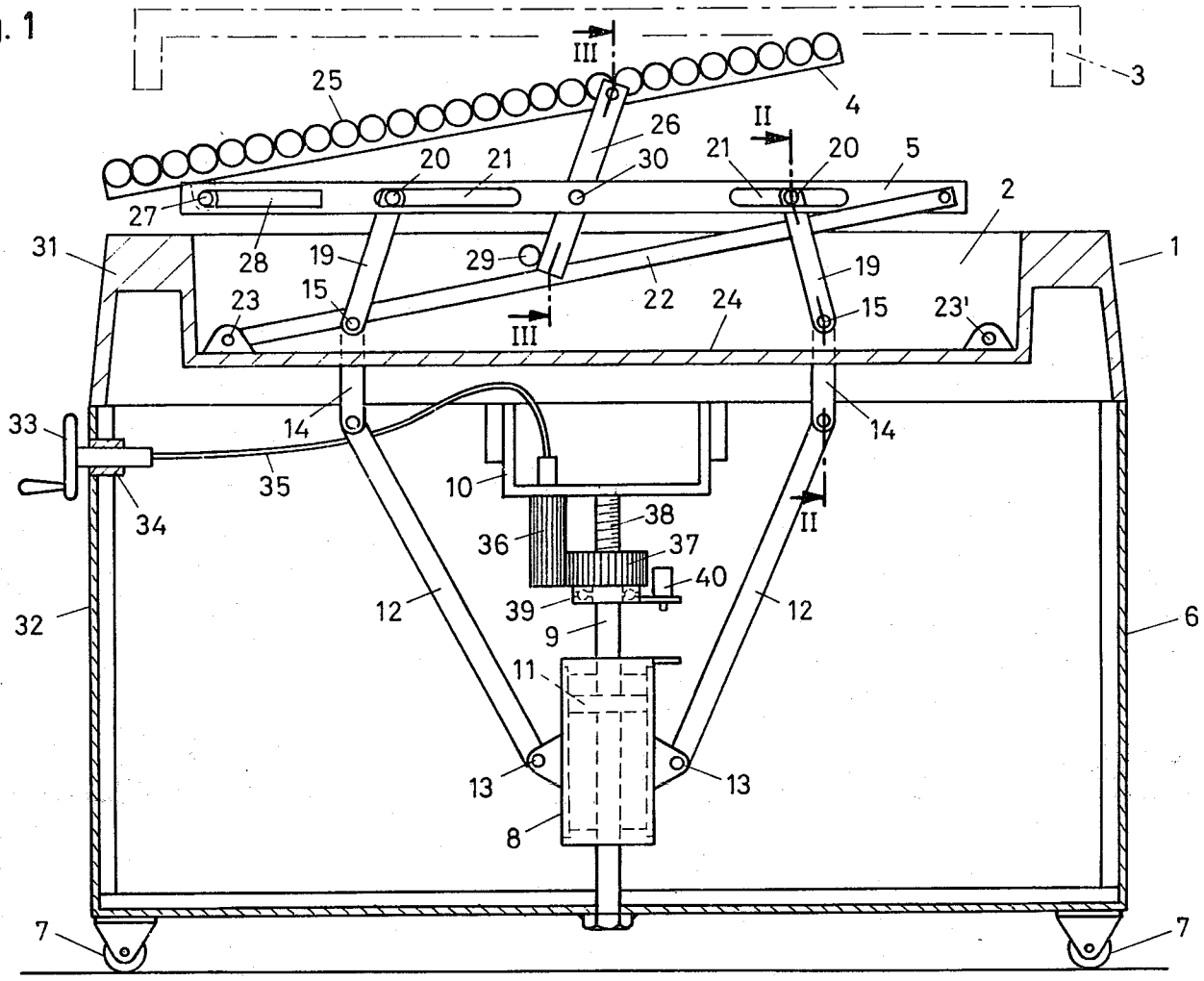
FIG. 1 shows a cross-sectional elevation of a vacuum packing machine according to the invention in which a roller surfaced stacking plate is in its ejection position.
Figure 2:
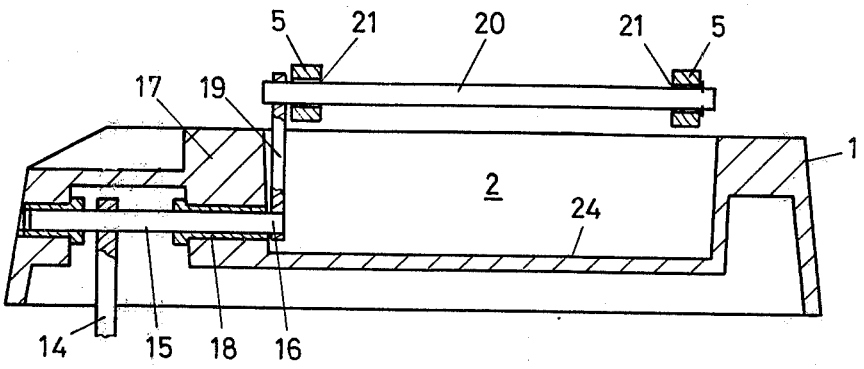
FIG. 2 shows a cross-section along line II—II of FIG. 1.
Figure 3:
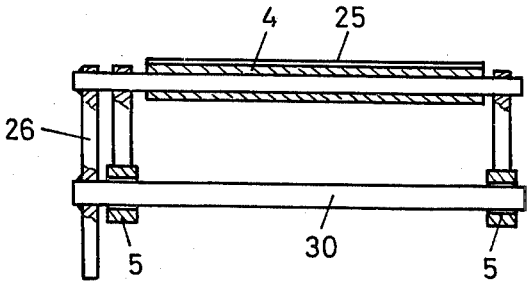
FIG. 3 shows a cross-section along line III—III of FIG. 1.

The machine has a housing 1 defining a vacuum chamber 2 for the bagged products. A removable cover 3, shown by the broken line in FIG. 1, serves to close the vacuum chamber in an airtight manner before evacuation.

The packing machine is mobile with the housing 1 being mounted on a frame 6 provided with wheels 7. A stacking plate 4 for the bagged product(s) is slidably and pivotally on a framework 5, and can be lowered into the vacuum chamber 2 together with the framework.

To lower the framework 5 a pneumatic cylinder jacket 8 is vertically installed in the frame 6 and is free to move up and down. The piston rod 9 of the cylinder is fixed to the bottom of the frame 6 and to a bracket 10 underneath the housing 1, and carries a piston 11.

When compressed air acts on the piston 11 from below, the cylinder jacket 8 moves to its extreme lower position, while it moves to its extreme upper position when compressed air is applied above the piston.

Support posts 13 are mounted on opposite sides of the cylinder 8, to each of which one end of a control lever 12 is pivotally fastened. Each lever 12 is pivotally attached to one end of a shorter lever 14 whose other end is rigidly secured to a horizontally disposed shaft 15 rotatably mounted in the housing 1. One end 16 of shaft

15 penetrates the wall of the housing through an airtight bearing 18. One end of a rocking lever 19 is fastened to the shaft end 16, and its other end carries a horizontal rod 20 supported in two slots 21 in the framework 5 lying opposite and aligned with each other. To control the angled or offset up and down movement of the framework 5, a counterpoise 22 is articulated at one end of the framework 5 and pivots at its other end around a flucrum 23 at the bottom of the vacuum chamber. By means of the two symmetrically disposed groups of levers 12, 14 and 19 and the counterpoise 22, the framework 5 is lowered into the vacuum chamber 2 with the upward stroke of the cylinder jacket 8 and is driven out of the chamber with the downward stroke of the cylinder jacket. During such movement the framework 5 always remains in a horizontal position.

The stacking plate 4 carries a roller train 25, and is connected to the framework 5 by a tilt lever 26 and a pivot axle 27. The latter is disposed at one end of the plate 4 and the framework 5, and is guided in a slot 28 in the framework. One end of the tilt lever 26 is articulated near the mid-section of the plate 4 and its free end projects into the vacuum chamber, where it bears against an inwardly extending bolt pin 29 under gravitational force of the stacking plate. The bolt pin 29 is firmly anchored in the housing 1. The tilt lever 26 is pivotally connected to the framework 5 at a point 30 located between its two ends.

If the framework 5 is now driven out of the vacuum chamber by activating the cylinder 8, it moves in the direction of one end 31 of the housing 1 in addition to being lifted upwardly. At the same time, the tilt lever 26 is pivoted in a counter clockwise direction by the bolt 29. Since the fulcrum 30 of the tilt lever is located in the framework 5, its upper end, to which the stacking plate 4 is attached, describes an arc of approximately 70° relative to the framework. This causes an inclination of the stacking plate through an angle of approximately 15° and, at the same time, the axle 27 is pushed against the outer end of the guide slot 28 so that the plate is moved over and projects beyond the edge 31 of the housing. The packed material lying on the roller train 25 now rolls off easily and is delivered to the next handling or processing station.

Depending upon whether product ejection is to take place to the left or to the right, the flucrum 23, 23' of the counterpoise can be at one or the other end of the bottom 24 of the vacuum chamber.

When the cylinder 8 is reversed and moves upward, the framework 5 is moved toward the middle and bottom of the vacuum chamber by the linkage 12, 14, 19 and the counterpoise 22. At the same time, the stacking plate 4 is hinged back into the plane of the framework, and as a result the end of the plate projecting beyond the edge 31 of the housing is also retracted.

The farther the cylinder jacket moves upward the deeper the framework sinks into the vacuum chamber 2 with the plate and the roller train, until the framework 5 finally rests on the bottom 24 of the chamber.

In order to pack relatively flat material it is not necessary for the framework 5 to sink all the way to the bottom of the chamber. An adjusting mechanism is therefore provided which permits adapting the depth of retraction to the thickness of the material to be packed. For that purpose a handwheel 33 is mounted at the front 32 of the carriage 6 by a setting ring 34. A flexible shaft 35 connects the handwheel 33 to a pinion 36 journalled in the bracket 10 under the housing, next to the end of the piston rod. The pinion meshes with a cogwheel 37 rotatably mounted on a worm gear portion 38 of the piston rod 9. Thus, by rotating the handwheel 33 the cogwheel 37 is screwed up or down on the piston rod.

A slip ring 39 is fastened at the lower end of the cogwheel 37, and serves as a stop for the cylinder jacket 8 in order to variably limit its stroke. A by-pass valve 40 mounted on the slip ring is activated when the cylinder jacket 8 strikes the slip ring, to thereby interrupt the supply of compressed air.

The vacuum packing machine that has been described is especially suitable for installation in a production line consisting, in order, of a rotating packing table, at least one but preferably two packing machines, and a conveyor belt leading to a hot-air tunnel and/or a labeling machine. The material to be packed is bagged on the packing table, and the operating personnel alternately supply the bags to one vacuum chamber or the other of the two packing machines, with the height of the material to be packed being adapted to the adjustable withdrawal depth of the stacking plates.

An automatically-closing cover 3 is preferably provided which welds the neck of each bag in a manner not shown in detail.

The emptied, sealed packages are ejected automatically and slide from the inclined roller train of the stacking plates onto the conveyor belt, from where they are taken to a shrinking station and/or a surface sealing and price marking station.

The semiautomatic operation makes it possible for a single person to operate two machines and to pack up to 1,000 kgs of meat per hour, for example. In spite of the rapid functioning and fast packing cycle, the high vacuum required for good storage of fresh meat is still maintained.

The supply to the machine is purposely not controlled by a continuous belt in order to avoid undue haste mistakes. The machines are supplied by hand but emptied automatically.

To seal the neck of the bag a lower sealing bar or a backing strip, not shown in detail, may be provided near the edge of the housing. The corresponding upper sealing bar is mounted on the cover. Alternatively, the sealing bars or the backing strip may be connected to the adjusting mechanism, so that they are adjustable relative to the stacking plate. In this manner the location of the seal can be varied when packing voluminous material.

What is claimed is:

1. A vacuum packing machine including a vacuum chamber and a cover member for sealingly closing the chamber, characterized by:

(a) a generally planar stacking plate for carrying bagged products to be vacuum packed, and (b) means for raising the plate out of the vacuum chamber to discharge the products and for lowering the plate into the chamber to an adjustable depth, said means comprising a horizontally disposed frame, means for raising and lowering the frame into and out of the chamber and simultaneously horizontally displacing the frame, and means mounting the plate above and to the frame for pivotal and slidable movement relative thereto.

2. A vacuum packing machine as claimed in claim 1, wherein one end of the plate is mounted to one end of the frame by a sliding hinge, and a tilt lever is pivotally connected to the plate at its one end, pivotally connected to the frame at its mid-section, and bears against a pin extending into the vacuum chamber at its other end, whereby the raising of the frame rotates the tilt lever to slide the hinge and tilt the plate relative to the frame, with the hinged ends of the plate and frame extending out over one end of the vacuum chamber.

3. A vacuum packing machine as claimed in claim 2, wherein the means for raising and lowering the frame comprises a fluid cylinder mounted below the vacuum chamber, and parallel linkage means connected between the cylinder and the frame, and sealing means for communicating the linkage means through a wall of the vacuum chamber.

4. A vacuum packing machine as claimed in claim 3, wherein the linkage means is slidably and pivotally connected to the frame, and further comprising a counterpoise bar pivotally connected to a bottom end corner of the chamber at its one end and to the most distant end of the frame at its other end.

5. A vacuum packing machine as claimed in claim 3, further comprising means for adjustably limiting the frame lowering stroke of the cylinder.

* * * * *